United States Patent [19]

Cardone

[11] Patent Number: 4,486,808

[45] Date of Patent: Dec. 4, 1984

[54] APPARATUS FOR CONTROLLING RANDOM CHARGES ON A MOVING WEB

[75] Inventor: Paul A. Cardone, Framingham, Mass.

[73] Assignee: Polaroid Corporation, Cambridge, Mass.

[21] Appl. No.: 446,564

[22] Filed: Dec. 3, 1982

[51] Int. Cl.[3] ..... H01T 19/04

[52] U.S. Cl. ..... 361/235; 361/214

[58] Field of Search ..... 361/235, 214, 220, 221, 361/212

[56] References Cited

U.S. PATENT DOCUMENTS

| | | | |
|---|---|---|---|
| 3,414,769 | 12/1968 | Hoffman | 361/235 |
| 3,475,652 | 10/1969 | Levy . | |
| 3,699,335 | 10/1972 | Giaimo, Jr. | 361/235 X |
| 3,716,754 | 2/1973 | Weber et al. | 361/235 X |
| 3,730,753 | 5/1973 | Kerr . | |
| 4,228,480 | 10/1980 | Benwood et al. | 361/235 |
| 4,271,451 | 6/1981 | Metz | 361/235 X |
| 4,306,271 | 12/1981 | Weber | 361/235 X |
| 4,383,752 | 5/1983 | Kisler | 361/235 X |

*Primary Examiner*—Reinhard J. Eisenzopf

*Attorney, Agent, or Firm*—John J. Kelleher

[57] ABSTRACT

Apparatus for neutralizing random electrostatic charges on a moving web that simultaneously leaves the web with either a uniform, positive, negative, or neutral charge. The apparatus includes one or more ion generators having at least one of said generators powered from both AC and DC power sources. An AC powered ion generator emits positive and negative ions that migrate to the moving web and neutralize oppositely charged areas located thereon. At the same time that the ion generator is being activated by AC power, DC power is superimposed on the same ion generator to control ion concentration and therefore the residual web charge.

5 Claims, 7 Drawing Figures

APPARATUS FOR CONTROLLING RANDOM CHARGES ON A MOVING WEB

BACKGROUND OF THE INVENTION

The present invention relates to apparatus for applying an electrostatic charge to a moving web, in general, and to apparatus for establishing a predetermined uniform charge level on a moving web of plastic or plastic coated material, in particular.

In the manufacture or handling of web materials, positive and/or negative electrostatic charges appear on such materials for any number of reasons. In web coating operations, for example, the presence of nonuniform electrostatic charges may cause a nonuniform-thickness coating to be deposited on a moving web which may result in the production of a coated web which is unsuitable or unacceptable for its intended purpose. If electrostatic charges appear on a web that has already been coated with a photographic emulsion, a spark produced by the discharging of such charges may cause localized exposure of the emulsion.

In product assembly operations such as the assembly of photographic film units into film packs or cassettes of the type sold by Polaroid Corporation under its registered trademark SX-70 Land Film, it is essential that the charge level on each film unit placed in such a film pack be at a very low level (preferably zero) in order to avoid having adjacent film units electrostatically attracted to one another. Film units of this type must be moved out of their cassettes and through a pair of adjacent fluid-spreading rollers at an optimum rate of speed in order to insure proper film unit developing. If sufficient attractive forces develop between adjacent film units, it may become difficult or even impossible for the film unit drive system to overcome this attractive force and move the film unit at the approprate rate of speed for proper film unit developing.

Previously available web charge-controlling apparatus such as that disclosed in U.S. Pat. No. 3,730,753 to KERR include a plurality of spaced-apart corona sources that are energized from either AC or DC power sources. While this apparatus produces a relatively uniform electrostatic charge on a moving web, it requires that the output voltage of each power supply be at a level that will produce corona and that a plurality of spaced-apart corona producing electrodes be provided together with space and means for mounting same.

A primary object of the present invention is to provide apparatus for establishing a predetermined uniform charge level on a moving web of plastic or plastic coated material.

Another object of the present invention is to provide apparatus for establishing a predetermined charge level on a randomly charged moving web that includes both AC and DC power sources wherein only the output of one of said power sources must have a magnitude that will produce corona.

A further object of the present invention is to provide a single corona-generating electrode that will both neutralize random electrostatic charges on a moving web and establish a particular residual charge level thereon.

Other objects, features and advantages of the present invention will be readily apparent from the following detailed description of the preferred embodiment thereof, taken in conjunction with the accompanying drawings.

SUMMARY OF THE INVENTION

In accordance with the teachings of the present invention, apparatus is provided for neutralizing random electrostatic charges of a moving web while simultaneously leaving the web with either a uniform, positive, negative, or neutral charge. The apparatus includes one or more ion generators having at least one of said generators powered from both AC and DC power sources. In one embodiment, both sources are connected to a single ion generator spaced from a grounded web-supporting backing roller and the randomly charged web is moved between said ion generator and said backing roller. In another embodiment, a pair of ion generators are employed and the AC source is of the type having two 180° phase separated outputs. One phase separated AC output is connected to one ion generator, the other phase separated AC output and the DC source are connected to the other ion generator and the randomly charged web is moved between and out of contact with said pair of ion generators. The AC powered ion generator(s) emit positive and negative ions that migrate to the web and neutralize oppositely charged areas located thereon, whereas the remainder of these positive and negative ions recombine. At the same time that one of the ion generators is being activated by AC power, DC power is superimposed on this particular ion generator to control ion concentration and therefore the residual web charge.

DESCRIPTION OF THE PREFERRED EMBODIMENTS

Figure 1:
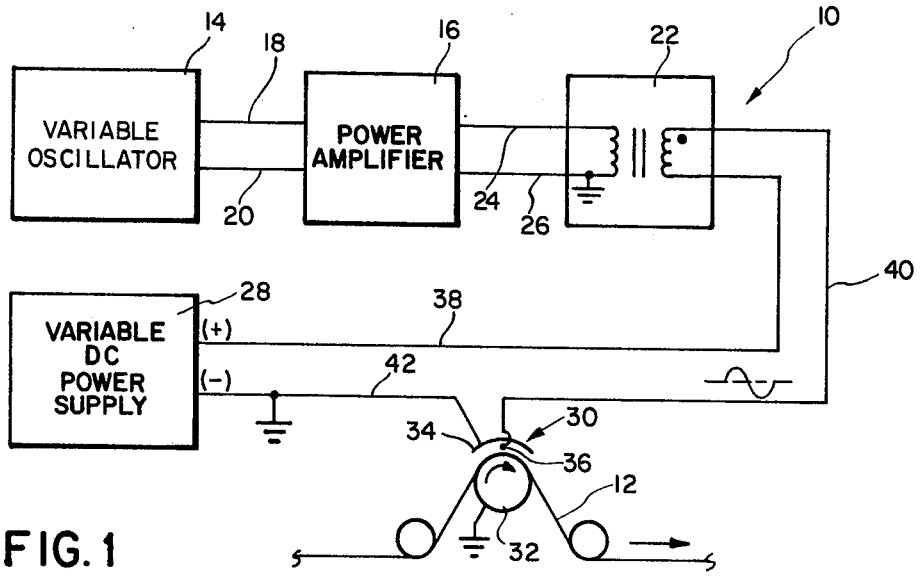
FIG. 1 is a schematic diagram of one preferred embodiment of the web-charging apparatus of the present invention employing an ion-producing electrode in combination with a grounded web-supporting backing roller for controlling electrostatic charges on a randomly charged moving web.

Turning now to the drawings, in FIG. 1 there is shown a schematic diagram of web-charging apparatus 10 employing an ion-producing electrode in combination with a grounded web-supporting backing roller for electrostatic charge control in accordance with a preferred embodiment of the present invention. In this particular charge-controlling application, the corona field produced by apparatus 10 is employed to place a uniform electrostatic charge of +300 V on randomly charged polyester web 12 having random positive and negative charges of approximately 4,000 V or less thereon, a web that is moving at the relatively low rate of speed of approximately 300 ft. per minute, said charge being applied a short period of time before the web is coated with an emulsion (not shown), in order to enhance the receptivity of said emulsion by said web and/or to improve coating uniformity.

Web charging apparatus 10 includes variable frequency/magnitude oscillator 14 whose output is preferably set at 600 Hz for the material and web speed noted. The output of oscillator 14 is applied to the input of power amplifier 16 through paths 18 and 20, and the amplified output of said power amplifier 16 is, in turn, applied to the input of high voltage step-up transformer 22 through paths 24 and 26. The output of transformer 22 can be varied by varying the magnitude of the output of oscillator 14 to produce a voltage magnitude of anywhere from 0 to 20,000 V AC. For a web having random positive and negative charges of 4,000 V or less, it was empirically determined that a transformer 22 output voltage of slightly in excess of 4,000 V is necessary to neutralize said random positive and negative web charges. In addition to the above, web charging apparatus 10 includes variable DC power supply 28 whose output voltage can be adjusted in order to achieve the desired electrostatic charge level which, in this particular instance, is +100 V Web charging apparatus 10 also includes shielded single-wire corona discharge device 30 mounted in a fixed position opposite rotatably mounted, electrically conductive backing roller 32. Corona discharge device 30 includes shield 34 partially enclosing wire 36 where ion-producing corona is formed. Shield 34 helps to focus ions produced by said corona at wire 36 onto a web surface where they are needed for charge level control.

The output of transformer 22 and DC power supply 28 are serially connected to one another and to corona device 30 in the following manner. One output terminal of transformer 22 is connected to the positive terminal of DC power supply 28 through path 38 and the other output terminal of said transformer 22 is connected to corona-wire 36 through path 40. The negative terminal of power supply 28 is connected to common system ground and is also connected to corona shield 34 through path 42. In addition, rotatably mounted support or backing roller 32 whose outer cylindrical surface forms an electrically conductive reference surface for web charging purposes is also connected to the common system ground.

When transformer 22 and power supply 28 are energized, an ion-generating corona field is established between corona discharge device 30 and the electrically conductive reference surface of backing roller 32. As web 12 is moved between discharge device 30 and backing roller 32, wire 36 alternately deposits positive and negative charge-neutralizing ions on the randomly charged surface of said web 12 in response to the alternating voltage being supplied by power source or transformer 22 to wire 36 thereby neutralizing these unwanted random charges on said web 12. The excess ions or ions not needed for web charge neutralization recombine and therefore also become neutralized. When neutralizing a randomly charged web with positive and negative ions from an alternating current source, a relatively small positive or negative bias voltage or charge level, of uniform magnitude, will be established on the web as a direct result of this type of charge-neutralizing process. In order to charge web 12 to the desired charge level, which in this particular instance is +100 V , the presence of this bias voltage must be taken into consideration. At the same time that positive and negative charge-neutralizing ions are being supplied to the randomly charged surface of web 12 by wire 36, said wire 36 is also supplying positive ions to said surface of web 12 in response to the constant DC voltage being supplied by variable DC power supply 28 for the purpose of establishing the desired residual charge level on web 12. The magnitude of said DC power supply 28 must be such that it both neutralizes the above-mentioned bias charge level, which may be of either polarity, as well as provide the voltage level necessary to establish the desired +100 V web charge level.

In operation, randomly charged web 12 is moved by drive means (not shown) between ion-producing corona discharge device 30 and grounded web-supporting backing roller 32 in order to establish a uniform precoating electrostatic charge on web 12 for the above-noted reasons. A positively-biased, time-varying corona field is established between device 30 and roller 32 by web charging apparatus 10 in accordance with time-varying curve 44 which is shown as a solid line in drawing FIG. 4A. This time-varying voltage causes a corona field that neutralizes random charges on web 12 whereas positive DC voltage or bias level 46 and the corona field resulting therefrom establishes the desired +100 V electrostatic charge level on said moving web 12.

Figure 4A:
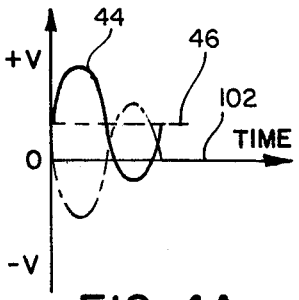
FIGS. 4A, 4B and 4C are graphs of voltages as a function of time of the voltage on the ion-producing electrode in FIG. 1 or 2 employed for producing either positive, negative or neutral charge levels on a randomly charged moving web, respectively.
Figure 4B:
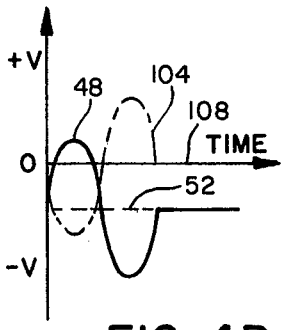
Figure 4C:
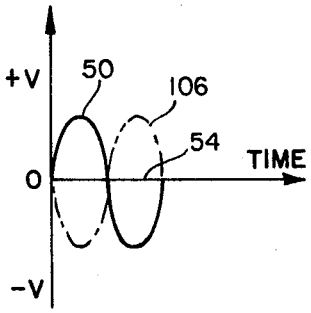

If instead of a positive residual charge level being established on web 12, either a negative or a neutral charge was preferred, the voltage between corona device 30 and backing roller 32 would be varied by transformer 22 in accordance with curve 48 in FIG. 4B or curve 50 in FIG. 4C, respectively. The voltages represented by said curves 48 and 50, which like those in FIG. 4A are not drawn to scale, vary about negative or neutral DC bias voltage levels 52 or 54, respectively. The magnitude of these bias voltages must be empirically determined in order to establish the desired negative or neutral electrostatic charge level on a particular randomly charged web. DC bias level 54 in FIG. 4C is represented as being at 0 V DC while, as a practical matter, it is normally slightly positive or negative, a polarity that depends upon the particular web charge-controlling problem encountered by charge-controlling apparatus 10.

The web charging apparatus of FIG. 1, an noted above, is preferably employed for the control of web charge levels on randomly charged webs that move at relatively low rates of speed. For webs moving at relatively high rates of speed, such as at a speed of 600 ft. per minute, the web charging apparatus of FIG. 2 will produce significantly more-uniform web charge levels than the just-described low speed web charging apparatus of FIG. 1.

Figure 2:
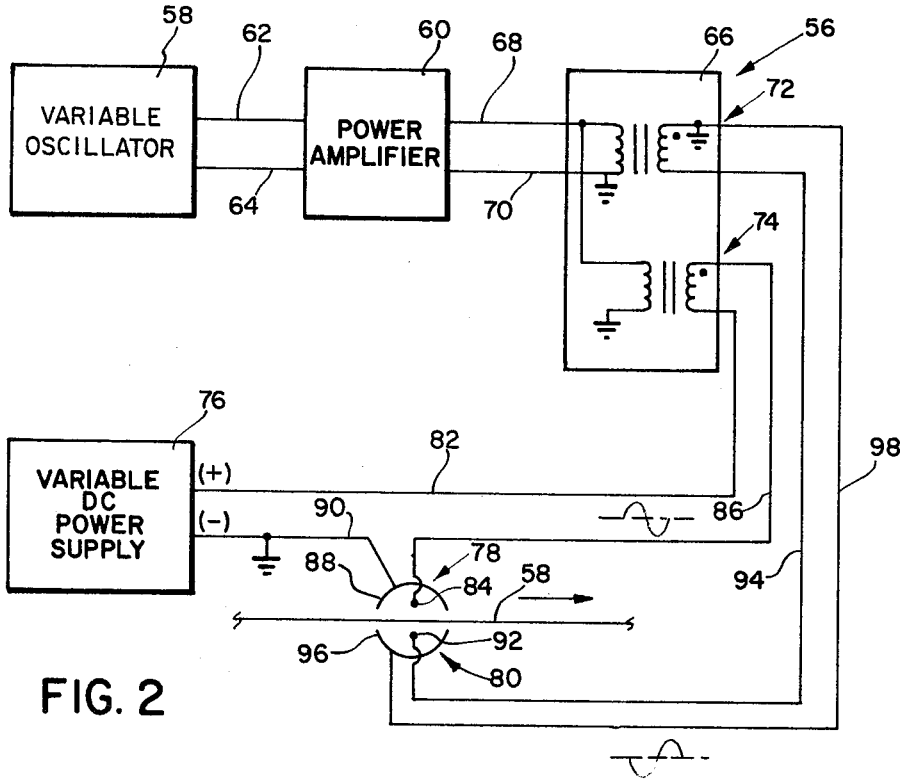
FIG. 2 is a schematic diagram of another preferred embodiment of the web-charging apparatus of the present invention employing a pair of opposed ion generators positioned on either side of and spaced from a randomly charged moving web.

Turning now to FIG. 2, relatively high speed web charging apparatus 56 shown therein employs a pair of opposed ion generators in accordance with another preferred embodiment of the present invention. In this charge-controlling application, ions produced by apparatus 56 are employed to place a uniform electrostatic charge of +100 V on randomly charged polyester web 58 having random positive and negative charges of approximately 4,000 V or less thereon, a web that is moving at the relatively high rate of speed of approximately 600 ft. per minute, for the same reasons put forth above with respect to web 12 in drawing FIG. 1.

Web charging apparatus 56 includes variable frequency/magnitude oscillator 58 whose output is set at 600 Hz for the above-noted rate of movement and material of web 58. The output of oscillator 58 is applied to the input of power amplifier 60 through paths 62 and 64, and the amplified output of said power amplifier 60 is, in turn, applied to the common input of the 180° phase separated dual outputs of high voltage step-up transformer 66 through paths 68 and 70. Each 180° phase separated output 72 and 74 of transformer 66 can be simultaneously varied by varying the magnitude of the output of oscillator 58 to produce the desired transformer 66 output. In addition to the above, web charging apparatus 56 includes variable DC power supply 76 whose output voltage can be manually adjusted in order to produce the desired above-mentioned +100 V electrostatic charge level on web 58. Web charging apparatus 56 also includes shielded single-wire corona discharge device 78 mounted in a fixed position oppositely fixedly mounted and shielded single-wire corona discharge device 80. Corona discharge device 78 includes shield 82 partially enclosing wire 84 where ion-producing corona is formed. Shield 82, similar to the corresponding shield in FIG. 1, helps to focus ions produced by said corona wire 84 onto a web surface where they are needed for electrostatic charge level control.

Output 74 of transformer 66 and variable DC power supply 76 are serially connected to one another and to corona device 78 in the following manner. One terminal of transformer output 74 is connected to the positive terminal of variable DC power supply 76, whose output can be varied to achieve the desired residual web charge level, through path 82, and the other output of transformer output 74 is connected to corona-wire 84 through path 86. The negative terminal of power supply 76 is connected to common system ground and is also connected to corona shield 88 through path 90. The terminal of transformer output 72 that is 180° phase separated from the corresponding output of transformer output 74 is connected to corona wire 92 through path 94 and the other output terminal of transformer output 72 is connected to system ground and to ion-focusing corona shield 96 of discharge device 80 through path 98.

In operation, randomly charged web 58 is moved between and out of contact with corona discharge devices 78 and 80 by drive means (not shown) in order to establish a uniform precoating +100 V electrostatic charge thereon in order to enhance coating receptivity by web 58 and/or to improve coating uniformity. A positively-biased, time-varying corona field is established between corona discharge devices 78 and 80 by web charging apparatus 56 in accordance with time-varying voltage curves 44 and 100 in drawing FIG. 4A. The voltage on corona discharge device 80, which is represented by dashed curve 100 in FIG. 4A (not drawn to scale) varies about 0 voltage level 102 in said FIG. 4A in accordance with the time-varying magnitude of the output voltage present at transformer output 72. Similarly, the voltage on corona discharge device 78, which is presently represented by solid curve 44 in FIG. 4A varies about DC bias voltage level 46. The change in magnitude of the AC voltage on corona discharge device 78 being at all times equal in magnitude and opposite in direction to the change in magnitude of the AC voltage on corona discharge device 80.

If instead of a positive residual charge level being established on web 58, either a negative or neutral charge was preferred, the voltage on corona discharge devices 78 and 80 would vary in accordance with curves 48 and 104 in FIG. 4B or curves 50 and 106 in FIG. 4C, respectively. The negative charge-producing voltages represented by curves 48 and 104 in FIG. 4B vary about negative DC bias level 52 and 0 bias level 108, respectively, whereas both of the neutral charge-producing voltages represented by curves 50 and 106 in FIG. 4C vary about 0 bias voltage level 54. As in the apparatus of FIG. 1, even though bias voltage level 54 in FIG. 4C is shown as having 0 V magnitude, power supply 76 must provide either a slightly positive or slightly negative DC bias voltage in order to overcome or neutralize the slight DC bias produced by the alternating, charge-neutralizing corona field generated between corona discharge devices 78 and 80.

DISCUSSION

Figure 3A:
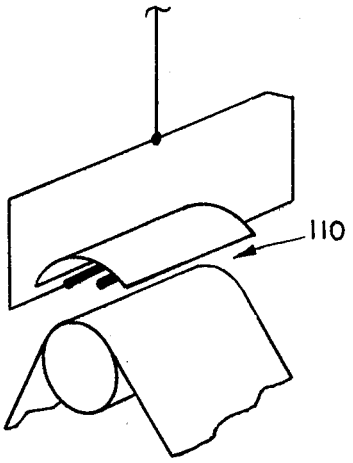
FIG. 3A is an enlarged detail of a two-wire ion emitter of the type preferably employed as the ion-generating electrode in the apparatus shown in either FIG. 1 or FIG. 2.

In the web-charging apparatus of FIGS. 1 and 2, a single-wire corona discharge device was illustrated therein in order to facilitate web charging apparatus description. However, a two-wire corona discharge device such as device 110 in drawing FIG. 3A is preferred over the single-wire device shown in both drawing FIGS. 1 and 2 because of the more uniform lateral charge distribution produced by a two-wire ion emitter. More uniform charge distribution is achieved by the reduced corona wire voltage drop that results when one end of one parallel wire and the opposite end of the other parallel wire are fed from a common source of electrical power.

Figure 3B:
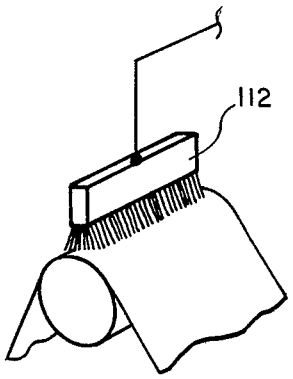
FIG. 3B is an enlarged detail of an ion-emitting conductive bristle brush that could be employed as an electrostatic charge controlling electrode in the apparatus of either FIG. 1 or 2.

Another possible, though less desirable, corona discharge device that may be substituted for those shown in FIGS. 1 and 2 is conductive bristle brush 112 shown in drawing FIG. 3B. However, because of inherent variable bristle length in said brush 112, electrostatic charge uniformity is not as good as that provided by single or two-wire corona discharge devices.

The electrostatic charge controlling apparatus of FIG. 2 is able to neutralize electrostatic charge levels on a moving web at relatively high rates of web speed because of the more rapid buildup in corona field-strength over that provided by the charge-controlling apparatus of FIG. 1. As shown by the time-varying voltage curves of either FIG. 4A, 4B or 4C, opposed ion generators or corona discharge devices 78 and 80 (FIG. 2) produce faster charge-neutralizing voltage changes between said devices than are produced between, for example, single corona discharge device 30 in combination with grounded web-supporting backing roller 32 of web charging apparatus 10 in FIG. 1.

Advantages flowing from the use of the inventive concept of the present invention include a reduced number of discharge devices together with the reduced space requirements for mounting same and the reduced complexity that would result in automatic electrostatic charge controlling apparatus incorporating an embodiment of the present invention. As important, however, is the energy that is saved when charge neutralization and residual charge level control are combined in a single corona discharge device. By combining these two functions in a single corona discharge device, only one power supply (normally the AC power supply) must have an output voltage level that will produce corona, whereas when these two functions are separate, both the AC and DC power supply output magnitudes must have an output level that will independently produce corona for adequate web charge control.

It will be apparent to those skilled in the art from the foregoing description of my invention that various improvements and modifications can be made in it without departing from its true scope. The embodiments described herein are merely illustrative and should not be viewed as the only embodiments that might encompass my invention.

What is claimed is:

1. Apparatus for establishing a uniform electrostatic charge on a moving web, comprising:

a first electrostatic charge-producing electrode mounted in a fixed position and spaced a finite distance from a surface of said moving web;

a first energizeable source of AC power;

an energizeable source of DC power;

a second energizeable AC source that is 180° phase separated from said first-mentioned source of AC power;

a second electrostatic charge-producing electrode mounted in a fixed position and spaced a finite distance from another surface of said web and generally opposite said first charge-producing electrode; and means for connecting said first AC source to said first charge-producing electrode in electrical series and said second AC source to said second charge-producing electrode such that said first and second charge-producing electrodes are 180° phase separated from one another to thereby establish an electrostatic charge-controlling field between said first and second electrodes and a predetermined uniform charge level on said moving web.

2. The apparatus of claim 1 wherein said electrostatic charge-producing electrode is a two-wire ion emitter and said reference surface is the outer surface of an electrically conductive backing roller.

3. The apparatus of claim 1 where said reference surface is an ion emitter electrode that periodically functions as a reference surface.

4. The apparatus of claim 1 wherein said AC power sources are a pair of single phase transformer output windings having a common input winding.

5. Apparatus for establishing a uniform electrostatic charge on a moving web, comprising:

a first electrostatic charge-producing electrode mounted in a fixed position and spaced a finite distance from a surface of said moving web;

a second electrostatic charge-producing electrode mounted in a fixed position and spaced a finite distance from another surface of said web and generally opposite said first charge-producing electrode;

at least two energizeable sources of AC power that are 180 ° phase separated from one another;

an energizeable source of DC power;

means for series connecting one of said AC sources and said DC source to said first charge-producing electrode and the other of said AC sources to said second charge-producing electrode such that said first and second charge-producing electrodes are 180° phase separated from one another to thereby establish an electrostatic charge-controlling corona field between said first and second electrodes and a predetermined uniform charge level on said moving web.

* * * * *